United States Patent [19]

Petty

[11] Patent Number: 4,574,232

[45] Date of Patent: Mar. 4, 1986

[54] RAPID TURN-ON VOLTAGE REGULATOR

[75] Inventor: Thomas J. Petty, Tempe, Ariz.

[73] Assignee: Motorola, Inc., Schaumburg, Ill.

[21] Appl. No.: 544,931

[22] Filed: Oct. 21, 1983

[51] Int. Cl.[4] ..... G05F 1/56

[52] U.S. Cl. ..... 323/268; 323/280; 323/901; 330/257

[58] Field of Search ..... 323/268, 273, 280, 281, 323/901; 330/257

[56] References Cited

U.S. PATENT DOCUMENTS

| | | | |
|---|---|---|---|
| 3,204,175 | 8/1965 | Kuriger | 373/273 |
| 3,255,366 | 6/1966 | McNulty et al. | 307/106 |
| 3,538,424 | 11/1970 | Frederiksen | 323/280 |
| 4,119,038 | 10/1978 | Allen et al. | 102/207 |
| 4,137,851 | 2/1979 | Weidner | 102/218 |
| 4,206,397 | 6/1980 | Dahlke | 323/273 |
| 4,476,428 | 10/1984 | Iwasawa et al. | 323/901 |

FOREIGN PATENT DOCUMENTS

| | | | |
|---|---|---|---|
| 117021 | 7/1982 | Japan | 323/281 |

OTHER PUBLICATIONS

Leung, "Short-Circuit Protection and Starting Device for Series Regulator", IBM Tech. Discl. Bul., vol. 7, No. 12, pp. 1234, 1235, May 1965.

*Primary Examiner*—William H. Beha, Jr.
*Attorney, Agent, or Firm*—Eugene A. Parsons

[57] ABSTRACT

An operational amplifier having negative feedback to provide voltage regulation and having a current pulse generator connected thereto for supplying a relatively large pulse of current to the amplifier upon initial application of power thereto for charging capacitances in the amplifier to quickly bring the circuit to an operating condition.

9 Claims, 2 Drawing Figures

RAPID TURN-ON VOLTAGE REGULATOR

BACKGROUND OF THE INVENTION

In many electronic circuits, and especially those wherein the power source is severely limited, it is essential that the electronic circuitry be turned on as rapidly as possible once power is applied thereto. In some instances inhibit signals are generated as power is initially applied and the inhibit signal prevents operation of attached circuitry until the voltage regulator has attained an operating condition. In some instances the inhibit signal is generated by the voltage regulator and in some instances the inhibit circuit may be generated by additional circuitry which receives power from the voltage regulator. If the voltage regulator takes too much time in the turn-on process the inhibit signal from the voltage regulator and the inhibit signal from the additional circuitry may not overlap and an unsafe period of time may result.

SUMMARY OF THE INVENTION

The present invention pertains to a rapid turn-on voltage regulator wherein amplifier means including negative feedback are utilized to provide a regulated voltage source, a power source is connected to the amplifier means and current pulse generating means are connected to the amplifier to provide a relatively high pulse of current upon the initial application of power to the circuit, the pulse of current being applied to the amplifier to charge capacitances therein rapidly and bring the amplifier to a rapid operating condition.

It is an object of the present invention to provide a new and improved rapid turn-on voltage regulator.

It is a further object of the present invention to provide a new and improved rapid turn-on voltage regulator which permits the voltage regulator to rapidly respond to power turn-on while maintaining low long-term current consumption.

It is a further object of the present invention to provide circuitry which speeds up the turn-on response of low bias current voltage regulators.

It is a further object of the present invention to provide a rapid turn-on voltage regulator which can be incorporated into a single integrated circuit.

These and other objects of this invention will become apparent to those skilled in the art upon consideration of the accompanying specification, claims and drawings.

BRIEF DESCRIPTION OF THE DRAWINGS

Referring to the drawings

DESCRIPTION OF THE PREFERRED EMBODIMENT

Figure 1:
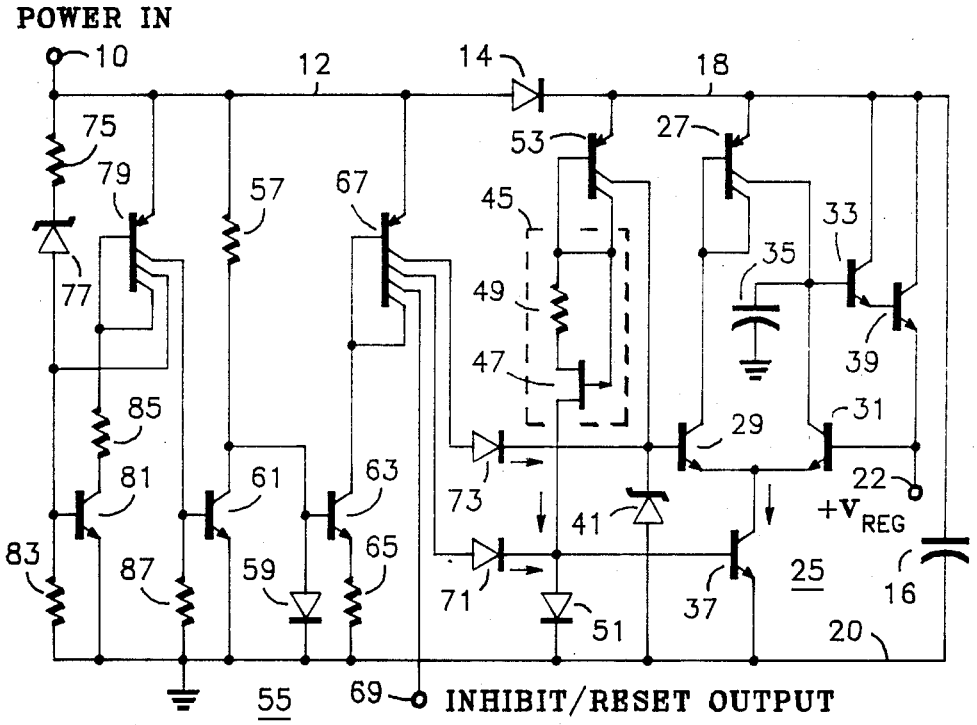
FIG. 1 is a schematic diagram of a voltage regulator incorporating the present invention.

Referring specifically to FIG. 1 an input terminal 10 is adapted to receive power thereon from some source (not shown). Generally the power source is some device that produces a pulse of power so that the power goes from zero to a maximum value and back to zero. Power applied to terminal 10 is connected by way of a bus 12 to the anode of a semiconductor diode 14. The cathode of diode 14 is connected to one terminal of a power storage capacitor 16 by way of a second bus 18. The opposite terminal of the capacitor 16 is connected by way of a bus 20 to a reference voltage, such as ground. In a typical application the terminal 10 receives a sudden and limited surge of power which is conducted through diode 14 to quickly charge the capacitor 16. Once the capacitor 16 is charged and the power applied to the terminal 10 begins to abate, the diode 14 prevents the bleeding off of power from the capacitor 16 back through the terminal 10 and other circuitry.

Regulated voltage is provided at an output terminal 22 by means of a differential amplifier, generally designated 25. The differential amplifier 25 includes a dual collector transistor 27 having an emitter connected to the bus 18, a base connected to the collector of a transistor 29 and to one of the collectors, and the second collector connected to the base of a transistor 31, to the base of a transistor 33 and through a capacitor 35 to ground. The emitters of the transistors 29 and 31 are connected together and to the collector of a transistor 37, the emitter of which is connected to the bus 20. The base of the transistor 31 is connected directly to the terminal 22, which provides the negative feedback for the operational amplifier 25. The collector of the transistor 33 is connected to the bus 18 and the emitter is connected to the base of a transistor 39, the collector of which is connected to the bus 18 and the emitter of which is connected to the output terminal 22. The voltage reference for the operational amplifier 25 is provided by means of a zener diode 41 which is connected from the base of the transistor 29 to the bus 20.

A microampere current source 45 supplies a bias current to the operational amplifier 25 and serves to maintain the current at a very low level, generally in the microampere range. The current source includes a junction field effect transistor 47 having a source terminal connected to one terminal of a resistor 49 and a gate connected to the other terminal of the resistor 49. The field effect transistor 47 has a pinch-off voltage of approximately one volt and the resistor 49 has a value of approximately 1 megohm so that current flowing through the field effect transistor 47 is approximately 1 microampere. The drain of the field effect transistor 47 is connected through a diode 51 to the bus 20 and to the gate of the transistor 37, which operates in conjunction with the diode 51 as a current mirror so that transistor 37 appears as a one-microampere current sink for the operational amplifier 25. A dual collector transistor 53 has the base and one collector connected together and to the other terminal of the resistor 49 (and the gate of the transistor 47). The emitter of the transistor 53 is connected to the bus 18 and the second collector is connected to the base of the transistor 29. The dual collector transistor 53 forms a second current mirror which mirrors the one-microampere current from the current source 45 into the reference voltage zener diode 41.

Current pulse generating means, generally designated 55, are connected to the bus 12 prior to the diode 14, which is the initial turn-on circuitry dependent upon the application of power to the terminal 10. The current pulse generator 55 includes a resistor 57 having one terminal connected to the bus 12 and the opposite terminal connected to the collector of a transistor 61, through a diode 59 to the bus 20 and to the base of a transistor 63. The emitter of the transistor 63 is connected through a current limiting resistor 65 to the bus 20 and the collector is connected to the base and to one of the collectors of a multicollector transistor 67. The emitter of the transistor 67 is connected directly to the bus 12. A second collector of the transistor 67 is connected to an output terminal 69 adapted to provide an inhibit/reset pulse thereon. A third collector of the transistor 67 is connected through a diode 71 to the anode of the diode 51 and the base of the transistor 37. A fourth collector of the transistor 67 is connected through a diode 73 to the anode of the zener diode 41 and the base of the transistor 29. The portion of the current pulse generator 55 just described turns on the generator to provide a current pulse which will be described presently.

To turn off the current pulse generated by the above described apparatus a resistor 75 has one terminal connected to the bus 12 and the other terminal connected to the cathode of a zener diode 77. The anode of the diode 77 is connected to one collector of a multicollector transistor 79, to the base of a transistor 81, and through a resistor 83 to the bus 20. The emitter of the transistor 79 is connected directly to the bus 12 and the base is connected through a resistor 85 to the collector of the transistor 81, the emitter of which is connected directly to the bus 20. A second collector of the transistor 79 is connected directly to the base thereof and a third collector is connected to the base of the transistor 61 and through a resistor 87 to the bus 20.

In the operation of the above-described circuitry, when the power input voltage at the input terminal 10 and bus 12 begins to rise, the current pulse generator 55 becomes activated through the current path formed by resistor 57 and diode 59. The voltage developed across the diode 59 is dropped across the transistor 63 and resistor 65, turning on the transistor 63 and, consequently, the transistor 67. When transistor 67 turns on a current is developed which is mirrored out of the three collectors thereof. Also, as the input voltage rises another current path is formed by transistor 53, resistor 49, field effect transistor 47 and diode 51. This path will be limited to approximately one microampere of current since the pinch-off voltage of the field effect transistor 47 will be forced across the one megohm resistor 49. The one microampere current is mirrored into the reference voltage zener diode 41 by transistor 53 and into the regulator bias current source 37 by diode 51. The pulse of current flowing in the diode 71 is added to the one microampere of current in diode 51 which is mirrored in the voltage regulator bias current source transistor 37. The current pulse flowing through the diode 73 provides additional bias current drive to the zener diode 41 so that the transistor 29 is driven sufficiently to use the additional bias current flowing in the transistor 37. The current pulse momentarily increases the bias current to the regulator which boosts the regulator turn-on response by rapidly charging parasitic, compensation, and/or filter capacitors in the amplifier 25 to their final steady state values.

After the regulator stabilizes, the current pulse terminates permitting the regulator circuitry to operate thereafter at a minimum bias current level, approximately one microampere in this embodiment. The current pulse generator turns off in the following manner. When the power input voltage reaches a predetermined amplitude, approximately equal to eight volts as determined by the junction breakdown voltages of diode 77 and transistor 81 in this embodiment, another current path is formed through resistor 75, zener diode 77 and transistor 81. This activates transistor 79 and, consequently, transistor 61 which steals the base current from transistor 63, causing the collector currents of transistor 67 to disappear leaving only the one microampere current sources from the field effect transistor 47 for bias current consumption in the amplifier 25. Transistor 79 provides a regenerative current to the base of transistor 81 which allows the power input voltage to fall back to zero without the current pulse generator turning on again. As stated previously, the power applied to the power input terminal 10 is a surge of current which is utilized to charge capacitor 16 and once the surge disappears the current generator 55 stops conducting completely and the voltage regulator operates from the capacitor 16 as a source of power. The voltage regulator composed of transistors 29, 31, and 27 form a differential to single ended converter amplifier that drives the Darlington feedback transistors 33 and 39. Capacitor 35 enhances the regulator's output response to transient currents induced by loading with switching circuitry. The entire circuit illustrated is implemented in a single integrated circuit, with the exception of the storage capacitor 16.

Figure 2:
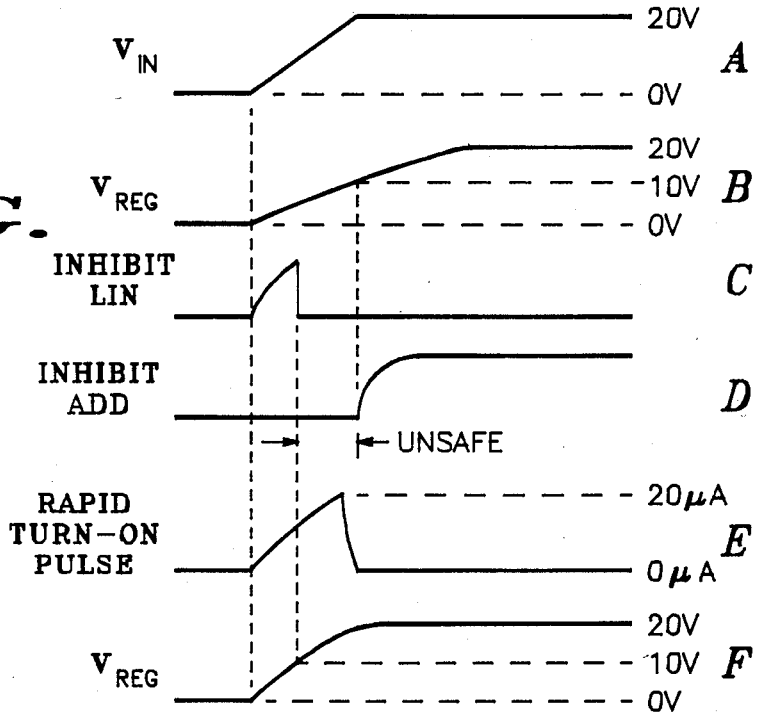
FIG. 2 illustrates various waveforms present at different points in the circuit of FIG. 1.

The collector of the transistor 67 connected to the output terminal 69 provides an inhibit signal current thereon for use in other circuitry. Referring specifically to FIG. 2, waveform A illustrates the voltage applied to the input terminal 10. Waveform B illustrates the regulated voltage available at the output terminal 22 in response to the voltge applied to input terminal 10, when the rapid turn-on circuitry is not utilized. As can be seen, the regulated voltage rises rather slowly because of the various capacitances in the amplifier 25 and because it takes a relatively long time for these capacitances to reach their final steady state values when only the one microampere bias current is flowing in the amplifier 25. The inhibit current available at the terminal 69 is illustrated in waveform C. An inhibit pulse developed in external circuitry (not shown) is illustrated in waveform D, which external circuitry turns on when the regulated voltage reaches a predetermined value, for example 10 volts. It can be seen that there is an unsafe period from the end of the inhibit pulse in waveform C to the start of the inhibit pulse in waveform D during which time no inhibit signals are available. The rapid turn-on circuitry described in the present invention solves this problem by providing the rapid turn-on pulse of current illustrated in waveform E. This pulse of current is supplied by way of diodes 71 and 73 to the amplifier 25 to cause the various capacitances in the amplifier 25 to rapidly charge to their final steady state values. The regulated voltage available at the output terminal 22 with the rapid turn-on pulse applied to the amplifier 25 is illustrated in waveform F. Referring to waveform F it can be seen that the regulated output voltage reaches the 10 volt state much more rapidly so that external circuitry turned on by the regulated voltage can provide an inhibit signal which cooperates with the inhibit signal of waveform C to make the circuitry completely safe.

Accordingly, a rapid turn-on voltage regulator is illustrated which can be formed in a single integrated circuit and which turns on rapidly to allow circuitry receiving power therefrom to turn on more quickly and prevent unsafe conditions. While I have shown and described a specific embodiment of this invention, further modifications and improvements will occur to those skilled in the art. I desire it to be understood, therefore, that this invention is not limited to the particular form shown and I intend in the appended claims to cover all modifications which do not depart from the spirit and scope of this invention.

I claim:

1. A rapid turn-on voltage regulator comprising:

amplifier means, including negative feedback, for providing a regulated voltage source at an output thereof, a power source coupled to said amplifier means;

a current source coupled to said amplifier means and said power source for providing a relatively small bias current to said amplifier means; and current pulse generating means coupled to said amplifier means and said power source for providing a pulse of current which is large relative to the bias current, to said amplifier means to rapidly bring said amplifier means to an operating level.

2. A rapid turn-on voltage regulator as claimed in claim 1 wherein the current source includes a microampere current source and a current mirror in an output thereof coupled to said amplifier means for adjusting current flowing in said amplifier means to equal that of said microampere current source and said current pulse generating means provides a pulse of current substantially larger than the bias current.

3. A rapid turn-on voltage regulator as claimed in claim 2 wherein the microampere current source includes a junction field effect transistor having source, drain and gate terminals and a known pinch-off voltage, and a resistor having one terminal connected to the source terminal of said transistor and an opposite terminal connected to the gate terminal of said transistor, said resistance means having a resistance value which in conjunction with the pinch-off voltage of said transistor limits the current flowing through the source/drain terminals of said transistor to a predetermined microampere current source.

4. A rapid turn-on voltage regulator as claimed in claim 3 wherein the current mirror is coupled to one of the opposite terminal of said resistor and the drain terminal of said transistor for mirroring the microampere current flowing through said transistor into said amplifier means.

5. A rapid turn-on voltage regulator as claimed in claim 4 wherein said amplifier means, portions of said power source, said current source and said current pulse generating means are formed in a single integrated circuit.

6. A rapid turn-on voltage regulator as claimed in claim 1 wherein the power source includes initial turn-on circuitry and an operating power source.

7. A rapid turn-on voltage regulator as claimed in claim 6 wherein said current source is coupled to said operating power source and said current pulse generating means is coupled to said initial turn-on circuitry.

8. A rapid turn-on voltage regulator as claimed in claim 7 wherein said current pulse generating means includes circuitry coupled to apply a surge of current approximately 20 times the bias current to said amplifier means upon initial application of input power to the rapid turn-on voltage regulator and circuitry for turning the surge of current off when the input power reaches a predetermined value.

9. A rapid turn-on voltage regulator as claimed in claim 6 wherein said operating power source includes a storge capacitor and said initial turn-on circuitry includes an input terminal adapted to receive input power and a semiconductor diode coupling said input terminal to said storage capacitor.

* * * * *